United States Patent [19]

Tamai

[11] 4,077,318

[45] Mar. 7, 1978

[54] APPARATUS FOR PRINTING UPON MOVING SHEETS, PAPER OR THE LIKE WITH AUTOMATIC TYPESETTING

[75] Inventor: Shinkichi Tamai, Kobe, Japan

[73] Assignee: Kobe Dockyard & Engine Works, Ltd., Japan

[21] Appl. No.: 678,541

[22] Filed: Apr. 20, 1976

[30] Foreign Application Priority Data

Apr. 21, 1975 Japan ..... 50-48801

[51] Int. Cl.[2] ..... B41J 1/20; B41F 17/00

[52] U.S. Cl. ..... 101/37; 101/38 A; 101/91; 101/111; 101/235; 101/DIG. 3

[58] Field of Search ..... 101/35, 91, 92, 111, 101/76, 77, 86, 87, 110, 109, 235, DIG. 3

[56] References Cited

U.S. PATENT DOCUMENTS

| | | | |
|---|---|---|---|
| 2,832,284 | 4/1958 | Farkas | 101/35 X |
| 3,540,372 | 11/1970 | Chambon | 101/92 |
| 3,624,730 | 11/1971 | Gottscho | 101/35 |
| 3,702,000 | 10/1972 | Delligatti | 101/35 X |
| 3,750,565 | 8/1973 | Hubbard et al. | 101/111 X |
| 3,938,436 | 2/1976 | Woodhouse | 101/76 X |

*Primary Examiner*—Clifford D. Crowder

*Attorney, Agent, or Firm*—McGlew and Tuttle

[57] ABSTRACT

A printing apparatus including a plurality of movable flexible endless belts incorporated in a plate drum which are aligned side by side, each of the endless belts being provided with spaced printing type on its outer peripheral surface and arranged side by side in at least on row within the plate drum. The endless belt has power transmitting means including an electromagnetic clutch which is coupled to a slip ring segment for feeding current to the clutch. A plurality of slip ring segments are arranged on substantially concentric circular lines. Every time each of the belts is displaced by a distance corresponding to one spacing between adjacent type, the displacement is detected as an electric pulse by a detecting means. A selected type can be brought to a specified position by the use of means for selectively determining the duration of energization of the electromagnetic clutch based on the detection effected as above. The transmitting means is driven by the electromagnetic clutch to automatically advance the endless belt by an amount required for the desired typesetting, and the electromagnetic clutch is engaged for the period of time specified by the duration determining means.

14 Claims, 18 Drawing Figures

18
18
18
15
18
15
15
15
19
19
19
19
19
19
19
19
18
18
18
18
2
15
17
15
1
19
17
21
19
19
21
21
19
21
21
23
23
22

APPARATUS FOR PRINTING UPON MOVING SHEETS, PAPER OR THE LIKE WITH AUTOMATIC TYPESETTING

BACKGROUND OF THE INVENTION

1. Field of the Invention

This invention relates to apparatus for printing sheets and plates of metal wood, plastics, etc. and pipes such as steel or other metal pipes, plastic pipes and the like. More particularly, the invention relates to a printing apparatus comprising printing means which include a plurality of movable flexible endless belts incorporated in a plate drum as aligned side by side, each of the endless belts being provided with printing types on its outer peripheral surface and is displaceable for automatic typesetting or composition.

2. Description of the Prior Art

With apparatus for printing sheets and pipes, it is often required to incorporate a row of several tens of printing means into a plate drum as a unit. Furthermore, since the printing of such articles involves frequent typesetting, it is essential that the apparatus be adapted for automatic typesetting. However, an apparatus has yet to be developed which fulfils both of these requirements for printing upon sheets and pipes.

As disclosed for example in Japanese Patent Publication No. 24419/1963, printing apparatus are known in which a plurality of printing wheels, displaceable by rotation, are arranged side by side and provided with printing type on the peripheral surface thereof to serve as printing means. The apparatus disclosed in the Japanese Patent Publication merely includes printing wheels.

Accordingly, the inventor has conducted research on an apparatus comprising several tens of printing means aligned as a unit and incorporated in a plate drum which apparatus is adapted for automatic typesetting. In the course of the research, the inventor encountered a serious problem. For automatic typesetting, each printing means must be provided with a pulley or like power transmitting means which includes an electromagnetic clutch. Thus there arises the necessity of incorporating the additional transmitting means into the printing means in a compact arrangement so as to minimize the space occupied by the row of printing means. This can be met by the use of a small electromagnetic clutch for the transmitting means, but since the printing means are great in number, requiring a great number of electromagnetic clutches and similarly a great number of slip rings for feeding current to the clutches, there still remains the problem that the large number of slip rings must be provided in a compact arrangement.

SUMMARY OF THE INVENTION

The main object of this invention is to overcome the above mentioned problems and to provide an apparatus for printing sheets, plates and pipes which comprises several tens of printing means arranged in at least one row as a unit and incorporated in a plate drum and which is adapted for automatic typesetting.

Another object of this invention is to provide an apparatus for printing sheets, plates and pipes comprising printing means which are operable in unison for automatic typesetting.

According to this invention, the printing means include movable flexible endless belts arranged side by side in at least one row and incorporated in a plate drum. Each of the endless belts is provided with a plurality of spaced printing type on its outer peripheral surface. The endless belt has power transmitting means including an electromagnetic clutch which is coupled to a slip ring segment for feeding current to the clutch. The slip ring segments are arranged on substantially concentric circular lines, whereby a large number of the slip ring segments can be mounted closely on the plate drum incorporating the printing means or on a member rotatable with the plate drum. With this invention, therefore, a small electromagnetic clutch, used as the above-mentioned clutch, is disposed in a side recess of a member such as a pulley included in the transmitting means for each printing means, with the result that the transmitting means are provided in a compact arrangement for all the printing means.

The apparatus of this invention is further equipped with means by which every time each of the belts, i.e. printing means, is displaced by an amount corresponding to the spacing between adjacent type, the displacement is detected as an electric pulse. The apparatus is further provided with means for selectively determining the duration of energization of the electromagnetic clutch based on the detection effected as above so that the printing means will be brought to the specified position desired. The transmitting means is driven by the electromagnetic clutch which is engaged for the period of time specified by the duration determining means, the transmitting means is driven to automatically advance the printing means by an amount required for the desired typesetting. In this way all the printing means can be driven in unison for automatic typesetting. Proximity switches disposed at specified locations are serviceable as the detecting means, while a computer is usable as the means for selectively determining the duration of energization of the electromagnetic clutches.

The type on the printing means selected for the desired composition are positioned at an opening in the peripheral surface of the plate drum. The selected type are inked by suitable means such as roll means.

With this invention, current is supplied to the slip ring segments for the electromagnetic clutches through brushes arranged in position.

The above and other objects and features of this invention will become more apparent from the detailed description of the preferred embodiments given below with reference to the accompanying drawings.

DESCRIPTION OF THE PREFERRED EMBODIMENT

Figure 6:
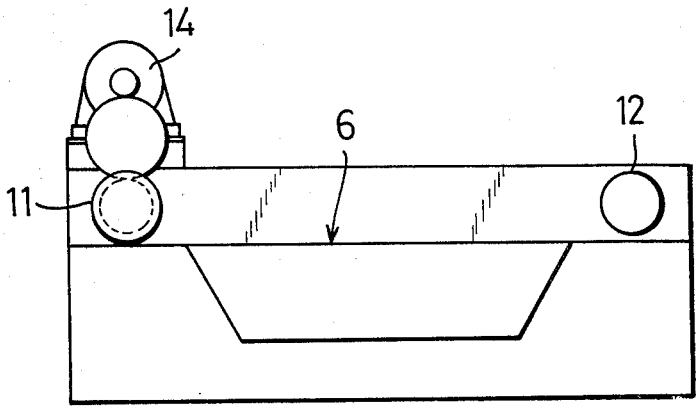
FIG. 6 is a detailed front view of means included in the embodiment shown in FIGS. 1 to 3 for moving the plate drum transversely of the apparatus.
Figure 7:
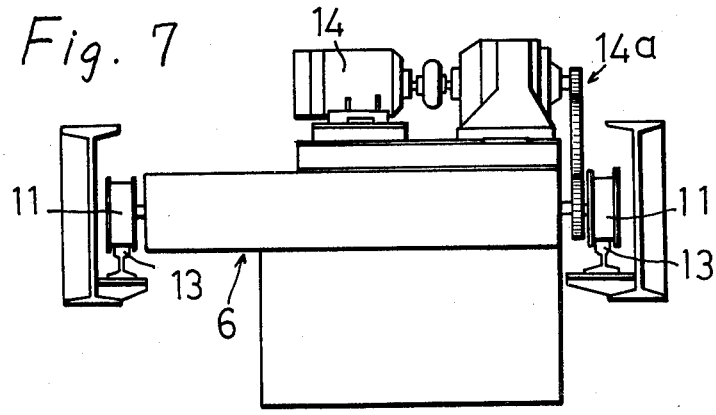
FIG. 7 is a detailed side elevation of the means shown in FIG. 6.
Figure 9:
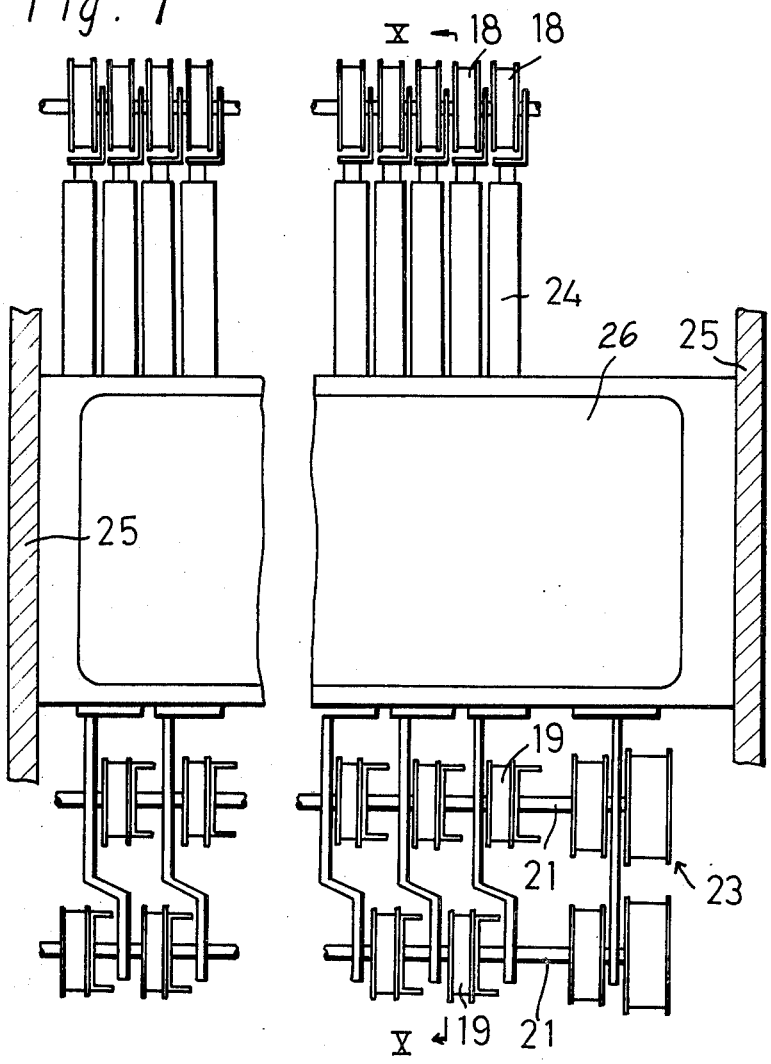
FIG. 9 is a front view showing the printing means and power transmitting means provided therefor.
Figure 8:
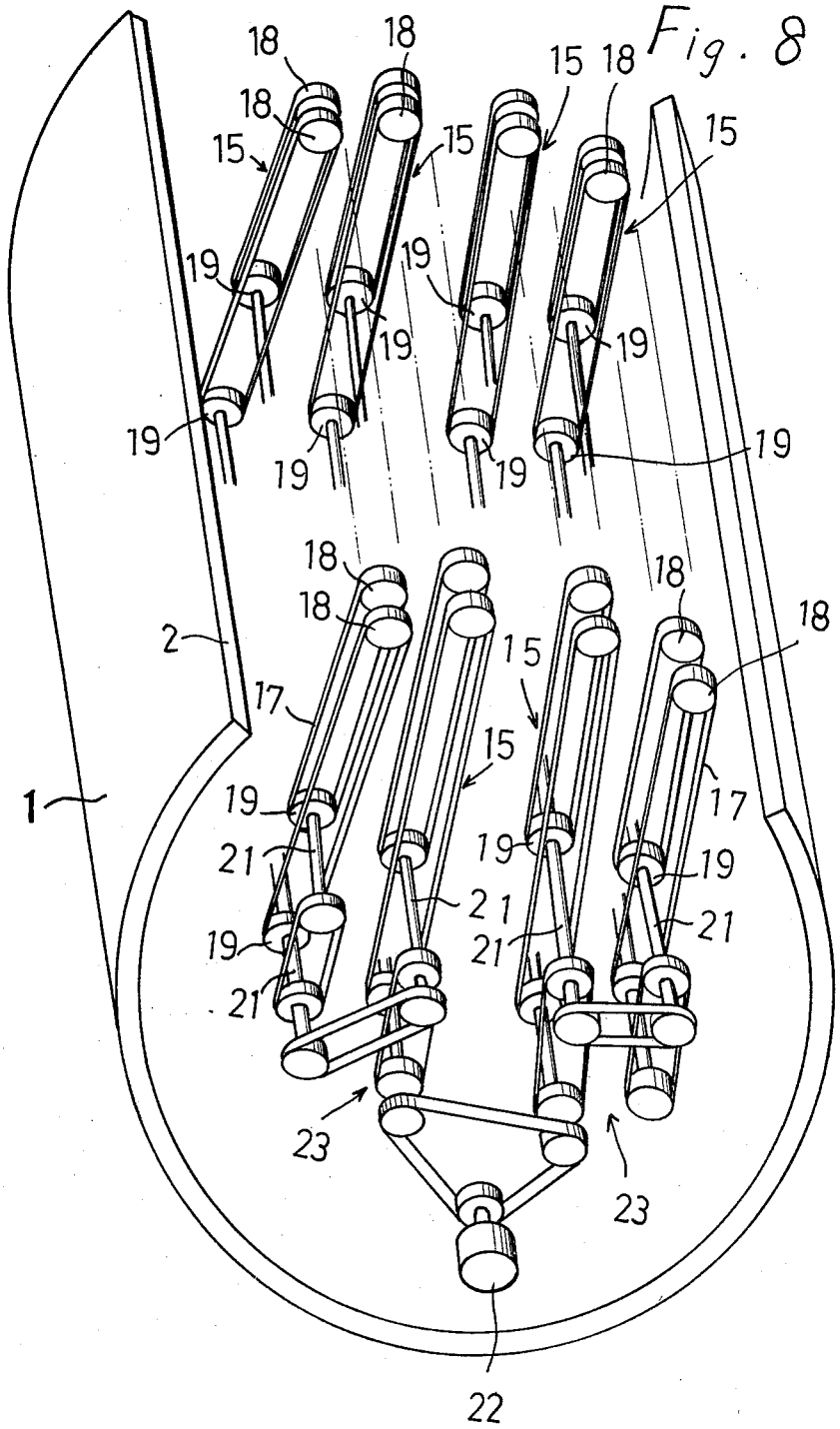
FIG. 8 is a partial perspective view of printing means included in the embodiment of FIGS. 1 to 3 and arranged side by side within the plate drum.
Figure 10:
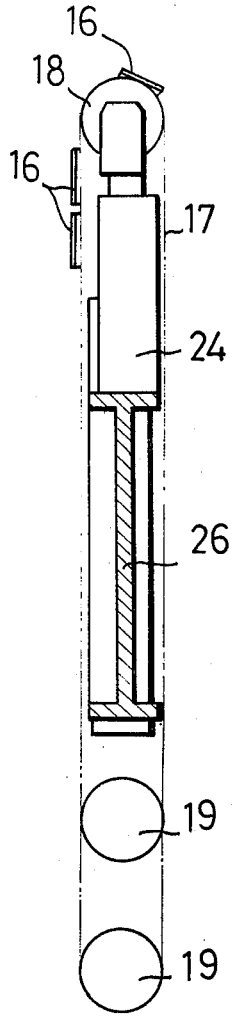
FIG. 10 is a sectional view taken along the line X—X in FIG. 9.
Figure 11:
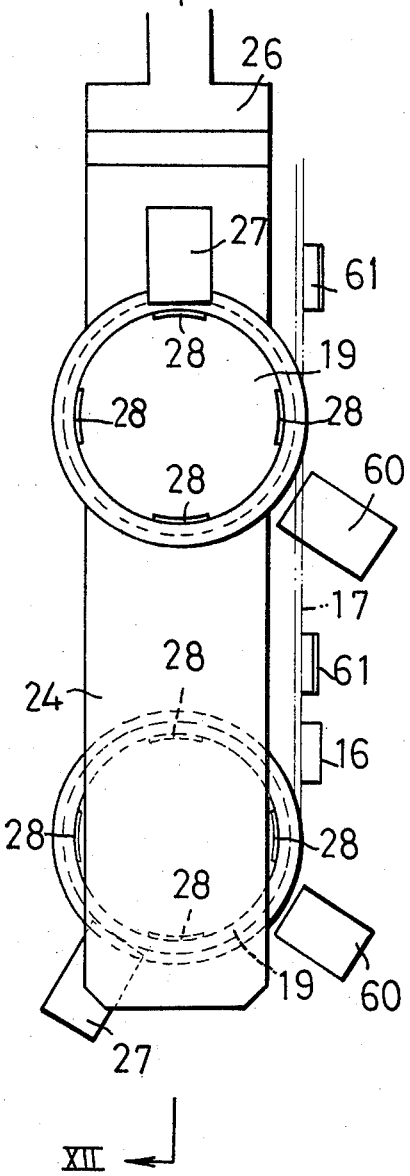
FIG. 11 is a detailed view showing a lower portion of the printing means.
Figure 12:
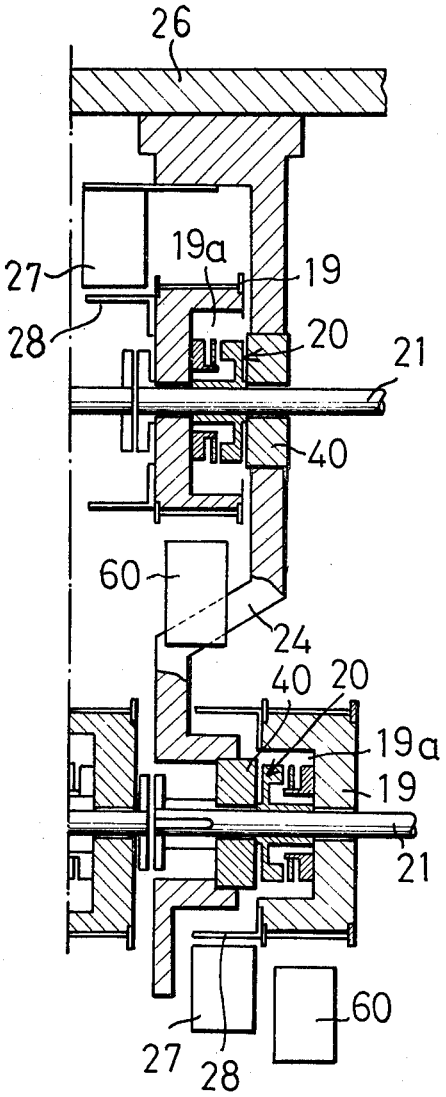
FIG. 12 is a sectional view taken along the line XII—XII in FIG. 11.

FIGS. 1 to 16 show an embodiment of this invention for printing sheets or plates (for example sheet steel). A rotatable plate cylinder, namely a drum 1 is formed with a longitudinal opening 2 in its peripheral surface. The drum 1 is supported at the opposite ends of its rotary shaft 3 by bearings 5 on the distal ends of pivotable support arms 4 (see FIGS. 1 and 2). The support arms 4 are pivotably supported by a rod 7 on a saddle 6. The support arms 4 are secured at their rear ends to a crossbar 8 which is supported by the ends of plungers 10 of air cylinders 9. The cylinders 9 are mounted on the saddle 6 by suitable known means, such as pins, which will not interfere with the pivotal movement of the support arms 4 about the rod 7. The saddle 6 has four wheels 11 and 12 which carry the saddle 6 on parallel rails 13 extending horizontally in the direction of width of the aricle *a* to be printed (in horizontal direction in FIG. 1). The wheels 11 and 12 are driven by a motor 14, mounted on the saddle 6, through transmitting means 14*a* (see FIGS. 6 and 7). When driven, the wheels move the saddle 6 and accordingly the drum 1 on the rails 13. The movement of the drum 1 controls the position of the printing means relative to the article *a* transversely of the apparatus. When the arms 4 are pivotally moved about the rod 7 by the plungers 10 of the air cylinders 9 through the crossbar 8, the drum 1 is thereby displaced upward or downward.

With reference to FIGS. 8 to 14, printing means 15 are accommodated in the drum 1. The printing means 15 include endless rubber belts 17 (FIGS. 10 and 11) each having a plurality of type 16 on its outer peripheral surface. The endless rubber belt 17 is reeved around a vertically opposed pair of pulleys 18 and 19 disposed within the drum 1. The belts 17 are aligned side by side longitudinally of the drum 1 in at least one row. Of the type 16 on the belts 17, those most remote from the center of the drum 1 are positioned outside the drum at the opening 2. The drive pulley of the pair is rotatably mounted on a drive shaft 21 for driving the drive pulley. The shaft 21 has an electromagnetic clutch 20 for the drive pulley. Preferbly two parallel drive shafts 21 may be provided for one row of the belts 17 aligned longitudinally of the drum 1 in order to increase the number of the belts 17 provided per unit space. With this arrangement of the drive shafts 21, the transmitting means for alternate aligned belts 17, are mounted on one of the shafts, while the transmitting means for the other intermediate belts are mounted on the other shaft, whereby the belts 17 can be arranged very closely and free of interference by the electromagnetic clutches 20. Each of the drive pulleys 19 for the belts 17 may be provided with a side recess 19*a* for accommodating the clutch 20. The belts 17 can then be arranged even more closely. The shafts 21 are driven by a motor 22 disposed in the drum 1 through suitable transmitting means 23 such as belts (see FIG. 8). Support frames 24 for the shafts 21 are connected to a beam 26 secured to the end plates 25 of the drum 1 (see FIGS. 9 and 10). Preferably, the frames 24 may be connected to the beam 26 with springs 42 interposed therebetween so as to adapt the types 16 for snug-fit contact with the article *a* to be printed even if its surface is slightly warped (see FIGS. 13 and 14). When such mode of connection is employed, the frame 24 is made movable as guided by the cooperation of slide shoes 43 and 46 mounted thereon and slots 45 and 47 receiving the respective shoes 43 and 46 therein and formed on a plate 44 secured to the beam 26. Slot 47 is at an angle to slot 45 so that the type 16 may be presented at all times in the proper orientation to the article *a*.

Means 27, such as a proximity switch, for detecting the displcement of each printing means 15 is fixedly mounted on the drum 1. Actuator pieces 28 coacting with the detecting means 27 to energize the detecting means are attached to the drive pulley 19 at circumferentially spaced locations thereof corresponding to the spacing between adjacent type 16 on the belt 17 (see FIGS. 11 and 12). The passing of type 16 is then sensed by the activation of detector 27 by passing actuator 28 which is positioned on pulley 19 adjacent type 16 on belt 17.

Figure 15:
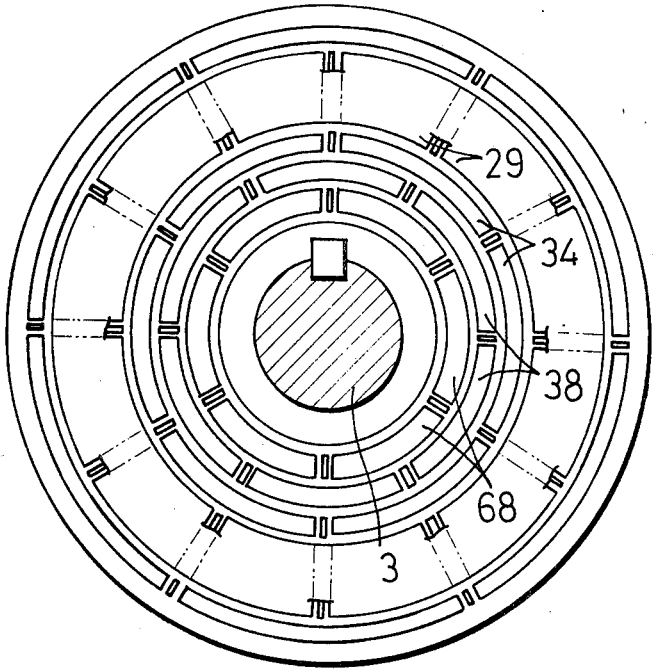
FIG. 15 is a front view showing a disc provided with slip ring segments for feeding current to electromagnetic clutches mounted on the transmitting means for the printing means.
Figure 16:
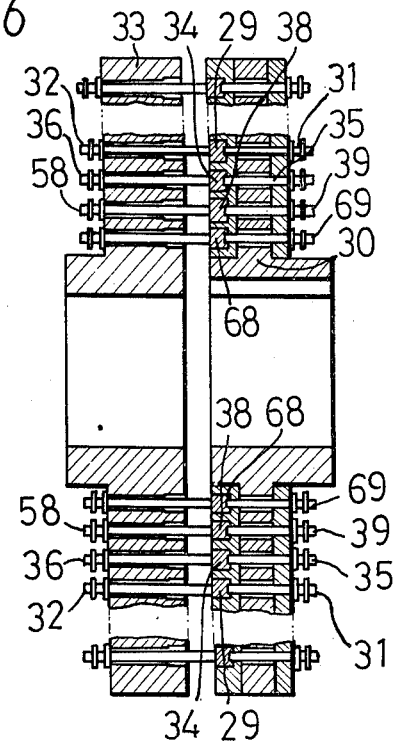
FIG. 16 is a side sectional elevation showing a stationary plate provided with brushes and opposed to the disc and slip ring segments.
Figure 17:
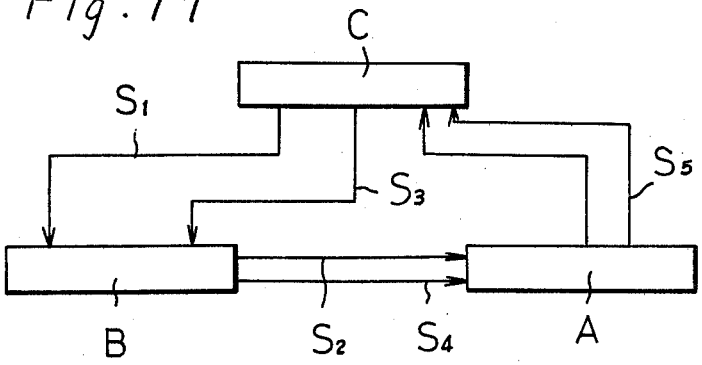
FIG. 17 is a block diagram schematically showing the typesetting operation according to this invention with use of a computer.

The detecting means 27 are electrically connected to slip ring segments 29 (See FIG. 15), and the electromagnetic clutches 20 to slip ring segments 34. With reference to FIGS. 15 and 16, the slip ring segments 29 and 34 are provided on a disc 30 keyed to the rotary shaft 3 of the drum 1 and are arranged along circular lines concentric with the rotary shaft 3, namely with the axis of the drum 1. The slip ring segments 29 and 34 have terminals 31 and 35 for connecting lead wires (not shown) to the detecting means 27 and the electromagnetic clutches 20. Brushes 32 and 36 for the slip ring segments 29 and 34 are mounted on a stationary disc 33. When the apparatus includes a very great number of belts 17 and therefore similarly a very great number of slip ring segments 29 and 34, the slip ring segments 29 for the electromagnetic clutches 20 may be mounted on one disc and those for the detecting means 27 on another disc. In this case, brushes 32 and 36 may be provided on the corresponding discs respectively. The brushes 32 for the slip ring segment 29 for the detecting means 27 are connected to the input terminals of a computer for receiving the pulse signals to be described later. The brushes 36 for the slip ring segments 34 for the electromagnetic clutches 20 are connected to typesetting instruction output terminals of the computer by way of a control unit for controlling the clutches 20 and the stopping means 37 to be described later. The overall system is schematically shown in the block diagram of FIG. 17, in which the apparatus of this invention is indicated at A as a whole, the control unit at B and the computer at C.

In preparation for printing operation, the drum 1 is held by the air cylinders 9 in its raised position, in which automatic typesetting or composition is conducted as will be described later.

Typesetting signals $S_1$ are sent out from the computer C to the control unit B, in response to which the control unit B emits instruction signals $S_2$ for energizing the magnets 40 of the electromagnetic clutches 20 in the apparatus A, whereby the magnets 40 are energized. With the engagement of the clutches 20, the drive shafts 21 are operatively connected to the pulleys 19 which in turn deliver the torque of the motor 22 to the belts 17 to drive the belts. The motor 22 may be held in rotation prior to the emission of the typesetting instruction signals $S_1$ or may be initiated into rotation simultaneously with the production of the signals.

Suitable detecting means 60 such as a proximity switch for detecting the reference point of each of the belts 17 is provided on the drum 1 on a specified portion of the support frame 24. An actuator piece 61 coacting with the means 60 is attached to each belt 17 and provides the reference point needed (see FIGS. 11 and 12). Slip ring segments 68 and terminals 69 for the detecting means 60 are provided in the same arrangement as the slip ring segments and terminals already described.

When the actuator piece 61 on the belt 17 passes by the corresponding detecting means 60, the detecting means 60 detects the reference point of that belt 17. Every time the belt 17 thereafter advances by one spacing distance between adjacent type 16, one of the actuator pieces 28 on the pulley 19 passes the location of the corresponding detecting means 27, which in turn detects the passage of the actuator piece. Thus every time the belt 17 advances, one spacing of type, the resulting displacement is detected by the detecting means 27 in the form of an electric pulse. The detecting means 27 feeds the pulses as pulse signals $S_5$ to a pulse counter (not shown) included in the computer C. The counter counts the pulses $S_5$. Thus, using proper logic circuitry in the computer C, a pulse from the sensor or detecting means 60 due to the passage of reference means or actuator piece 61 will inform the computer that it must then start counting pulses from detecting means 27 as actuated by actuators 28. Since this corresponds to the passage of various type 16 and since the arrangement of the type on belt 17 is known, the desired type 16 can be counted off and positioned in the opening 2 of the drum 1.

Prior to the above operation, typesetting information has been fed to the computer C to bring the desired type 16 on the printing means 15 to the position of the opening 2 of the drum 1. The information may be fed by unillustrated means such as a magnetic tape, punch card or the like encoding the information or by a main computer (not shown). When each of the belts 17 has advanced a specified distance, the computer C feeds a stop instruction signal $S_3$ to the control unit B, which in turn feeds a deenergizing instruction signal $S_4$ to the electromagnetic clutch 20, whereupon the electromagnet 40 of the clutch 20 is deenergized. The clutch 20 is therefore disengaged to halt the belt 17. In this way an automatic typesetting operation is completed.

Figure 13:
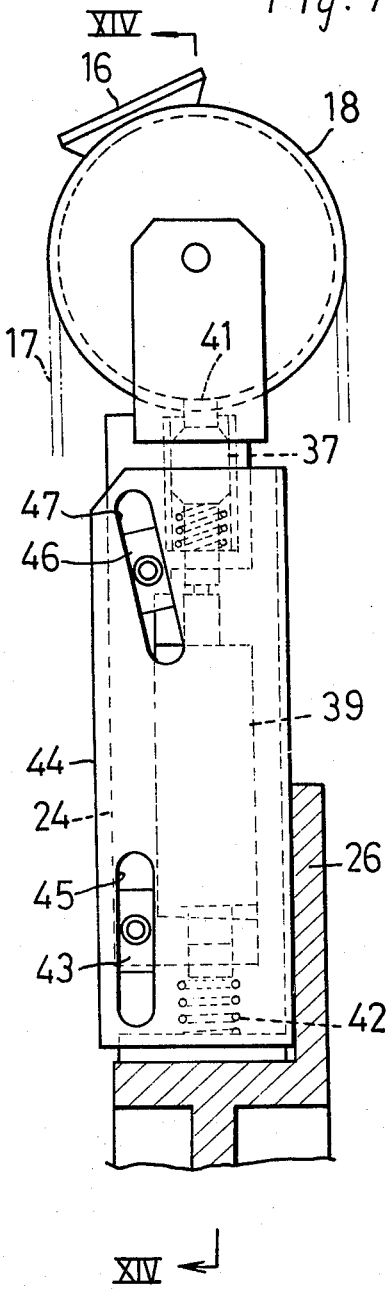
FIG. 13 is a detailed view showing an upper portion of the printing means.
Figure 14:
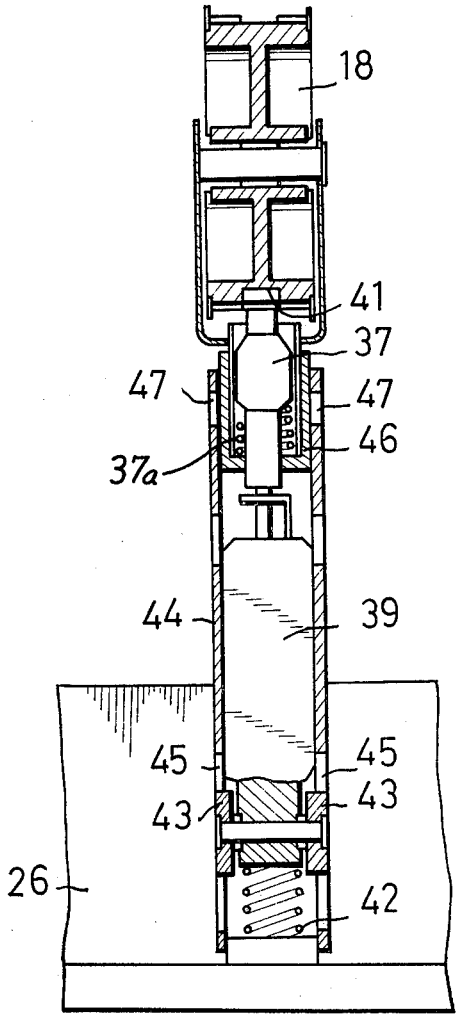
FIG. 14 is a sectional view taken along the line XIV—XIV in FIG. 13.

In order to stop the belt 17 accurately in the specified position, either of the pulleys 18 and 19 of each printing means 15 may preferably be provided with stopping means 37 which is shown connected to the plunger of an electromagnet 39 stopper (see FIGS. 13 and 14). For application of current to the electromagnet 39 of the means 37, there is provided a slip ring segment 38 in the same manner as the slip ring segments 29 and 34. A brush 58, like the brushes 32 and 36, is provided for the slip ring segment 38.

During the travel of the belt 17, the stopping means 37 has its electromagnet 39 energized and is thereby held out of engagement with recesses 41 formed in the pulley 18, without interfering with the advance of the belt 17. When the electromagnetic clutch 20 is disengaged, the electromagnet 39 of the stopping means 37 is deenergized, permitting the stopping means 37, through the action of biasing spring 37*a*, to engage in the recess 41 again and to thereby restrain the printing pulley 18 and therefore the belt 17 against movement. The recesses 41 are spaced circumferentially on the pulley, by a distance corresponding to the spacing of the type 16 on the belt 17. The stopping means 37 is guided for movement in slide shoe 46 and against spring 37*a*.

Figure 1:
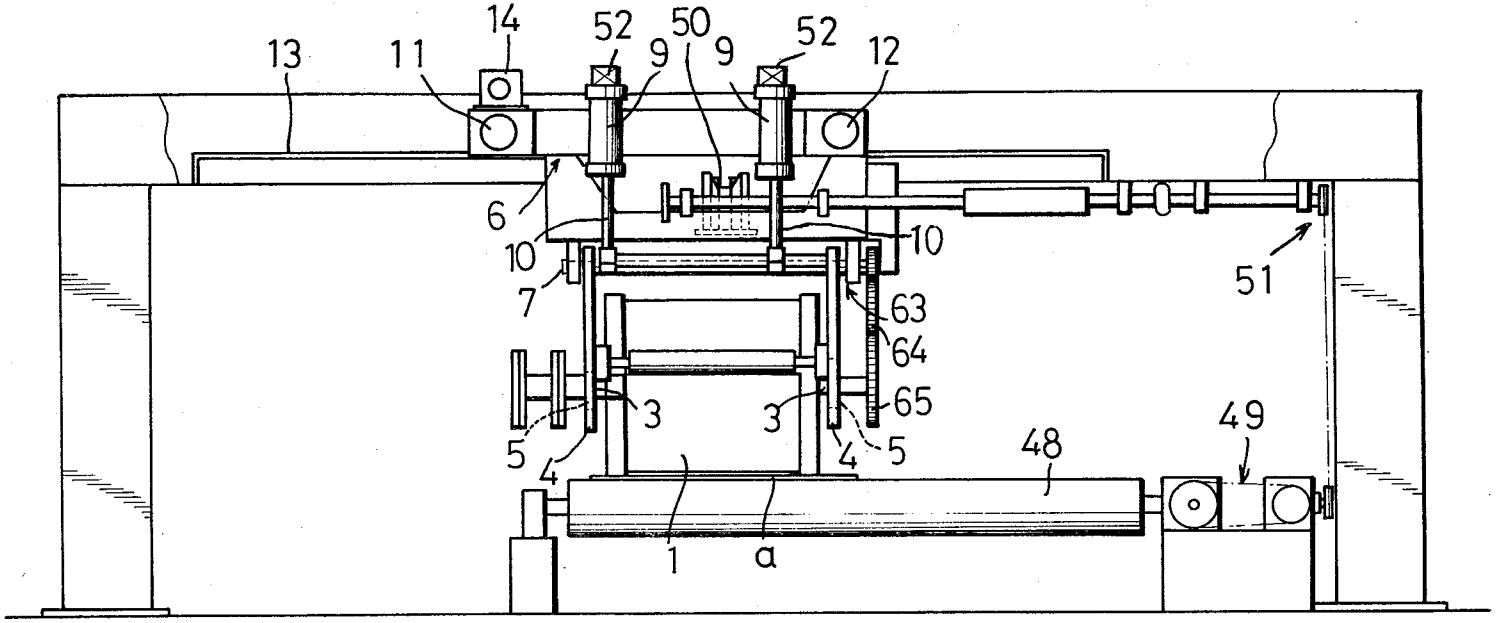
FIG. 1 is a schematic front view showing a preferred embodiment of the invention in its entirety.
Figure 2:
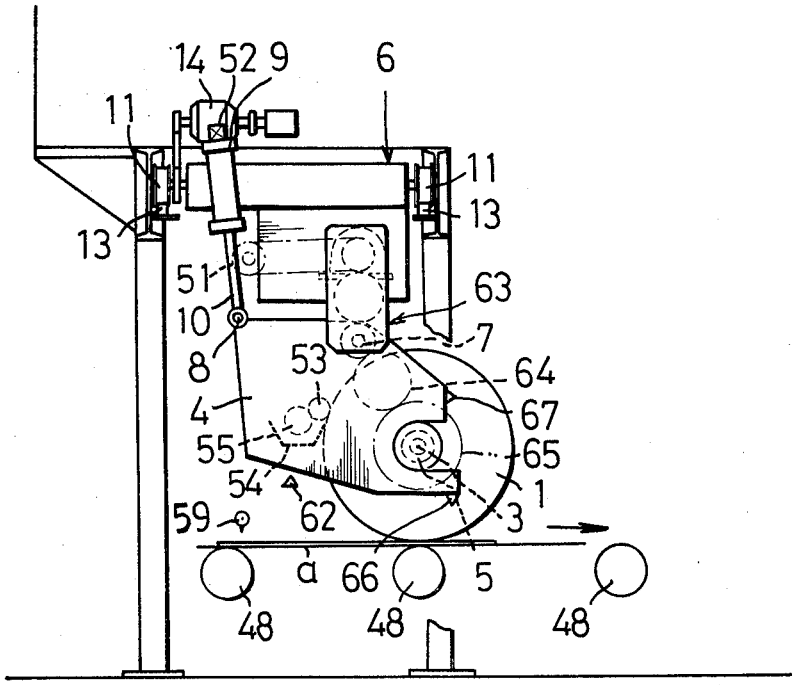
FIG. 2 is an overall side elevation of the embodiment shown in FIG. 1.
Figure 3:
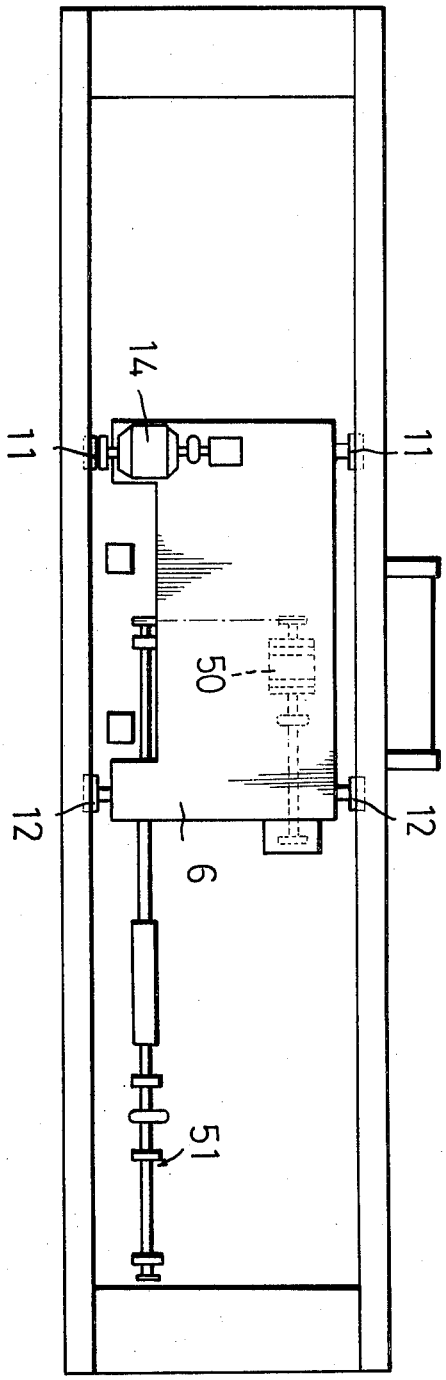
FIG. 3 is an overall plan view of the embodiment shown in FIG. 1.
Figure 4:
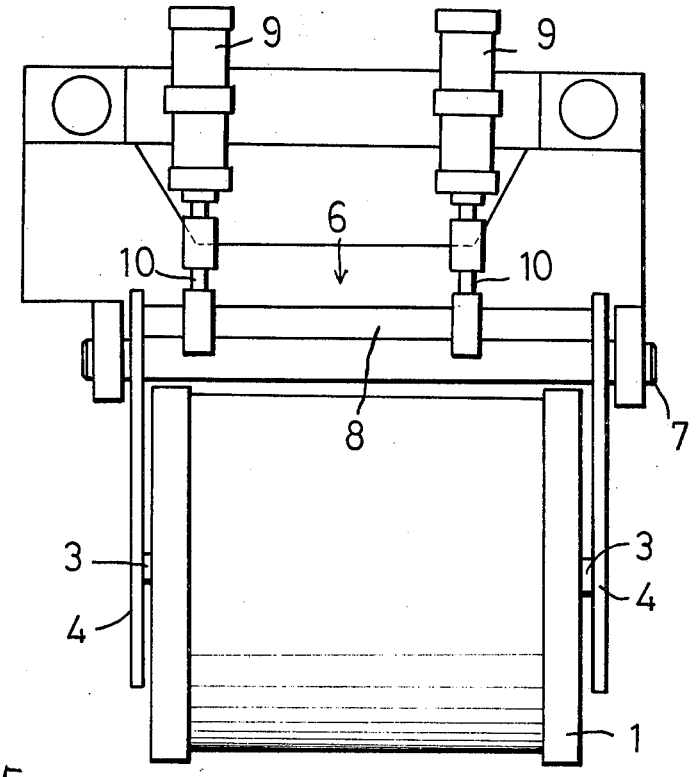
FIG. 4 is a detailed front view showing means included in the embodiment of FIGS. 1 to 3 for raising and lowering a plate drum.
Figure 5:
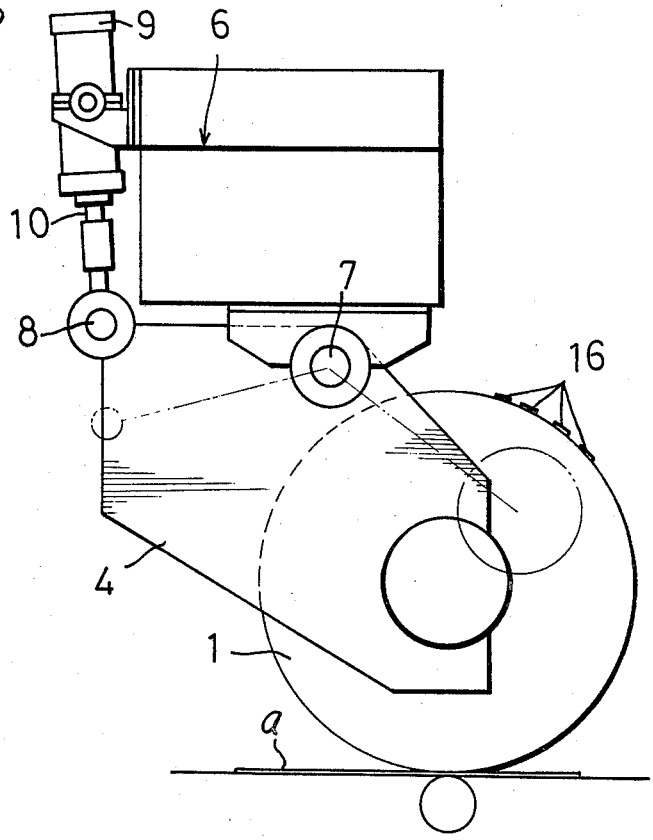
FIG. 5 is a detailed side elevation of the means shown in FIG. 4.

With reference to FIGS. 1 to 3, the drum 1 is coupled to drive means 49 for a suitable conveyor such as a roller conveyor 48 for transporting the articles *a* (sheets or plates) to be printed, via power transmitting means 51 including an electromagnetic clutch 50 equipped with a brake, a reduction gear 63 associated with the clutch 50 and transmission gears 64 and 65 to which the power is delivered from the reduction gear 63. The gear ratio involved in the system coupling the drive means 49 to the drum 1 is so determined that the velocity of advance of the article *a* on the conveyor 48 is equal to the circumferential velocity of the composed types in opening 2 of the drum 1.

The article *a* to be printed is advanced by the conveyor 48 to the printing position from the left hand side of FIG. 2 toward the right. The article *a* brought to the specified position is detected by suitable sensing means 59 such as a photoelectric cell (see FIG. 2), whereupon the electromagnetic clutch 50 is energized, initiating the drum 1 into rotation by way of the reduction gear 63 and gears 64, 65. At the same time, current is applied to electromagnets 52 (FIGS. 1 and 2) on the air cylinders 9 to energize the magnets. The air cylinders 9 operate the plungers 10, lowering the drum 1 onto the advancing article *a*. When the drum 1 has been lowered to position, the electromagnets 52 on the air cylinders 9 are deenergized, and the drum 1 is stopped. The electromagnets 52 are controllable for example by a proximity switch 62 (FIG. 2) disposed in position and an actuator piece (not shown) attached to the arm 4.

The drum 1 now rotates in the printing position at such velocity that the circumferential velocity of the composed types thereon is equal to the velocity of advance of the article *a* printing the aritcle *a* with the types set on the printing means 15 in the drum 1.

The types 16 are inked by the following system. FIG. 2 shows an inking roller 53 mounted on the support arms 4 for the drum 1 and rotatable by suitable transmitting means (not shown) at the same peripheral velocity as the types when the drum 1 rotates. The roller 53 is held in contact with a rotatable roller 55 disposed in an ink fountain 54 on the support arms 4 and immersed in the ink in the fountain 54 to a suitable depth. The ink is supplied by the roller 55 to the inking roller 53, from which the types 16 pick up the ink when coming into contact with the roller 53 during the rotation of the drum 1. The contact pressure of the inking roller 53 on the types 16 is controllable by suitable means.

When the article to be printed is at room temperature, the printing ink usable in this invention may be a flexographic printing ink or like known ink suitable for the article. When the article is at a high temperature as is the case with sheet steel sent out from the final step of a rolling process at a temperature for example of 100° to 550° C, a known heat-resistant aqueous ink may be used.

Suitable means such as a proximity switch 66 (FIG. 2) mounted on a support arm 4 detects the completion of printing operation in cooperation with an actuator piece (not shown) on the drum 1, whereupon the air cylinders 9 are operated to raise the plungers 10. Consequently the drum 1 is raised while rotating.

Suitable means such as a proximity switch 67 mounted on the support 4 and coacting with an actuator piece (not shown) on the drum 1 detects the elevation of the drum 1 to a predetermined position. Based on the detection, the drum 1 is brought out of rotation and upward movement. Thus the drum 1 is returned to the initial position for the subsequent printing operation. In this position the printing means 15 on the drum 1 are set for a new composition when so desired.

The printed article *a* is sent out from the apparatus by the conveyor 48 as indicated by the arrow in FIG. 2.

Figure 18:
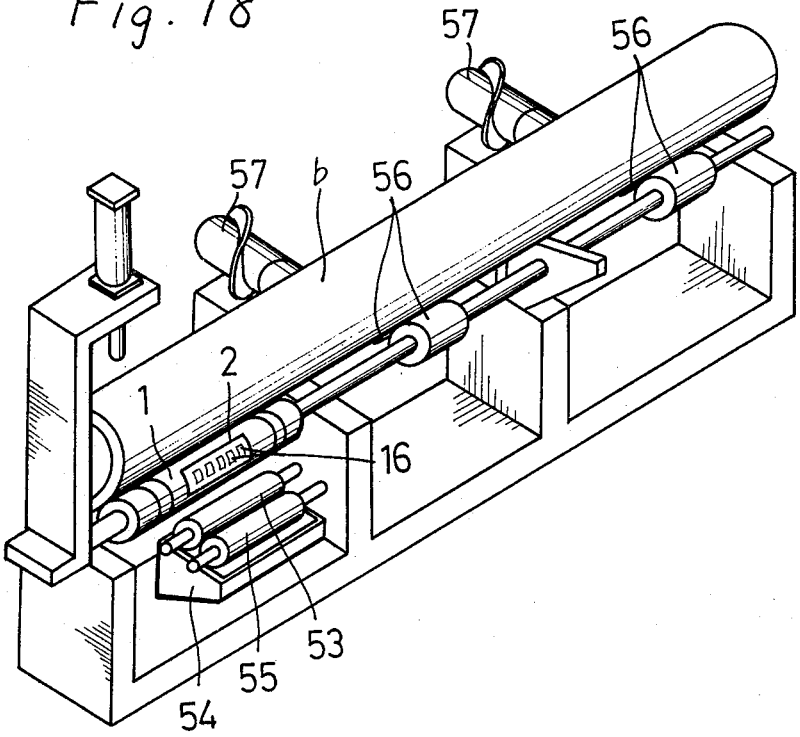
FIG. 18 is a perspective view showing another embodiment of this invention.

FIG. 18 shows another embodiment of this invention for printing pipes such as steel pipes. Throughout FIGS. 1 to 18, like parts are referred to by like reference numerals. In the construction of the principal part, the embodiment is substantially the same as the foregoing embodiment of FIGS. 1 to 16 except that the drum 1 is fixedly mounted in position and is not movable upward or downward and that the article *b* (pipe) to be printed is rotated in a fixed position for printing as supported by a suitable number of pairs of support rollers 56. Accordingly FIG. 18 shows the embodiment only schematically. The tube *b* is fed onto the support rollers 56 by suitable known means such as a conveyor (not shown). After printing, the pipe *b* is transferred by unillustrated suitable means onto parallel screw conveyors 57, which send out the pipe from the apparatus.

When a rubber belt is used as the belt 17 of this invention, it is preferable to substantially cover the surfaces of the types 16 with fluorine-containing resin. Type covered with fluorine-containing resin can be prepared by a suitable known method. They give sharp prints over a prolonged period of use because of their high durability and are well suited especially for printing sheet steel immediately after a rolling operation because of their high heat resistance.

Although this invention has been described above with reference to the preferred embodiments, it will be apparent to one skilled in the art that the invention is not limited to these embodiments but can be modified without departing from the scope of the invention.

What is claimed is:

1. An apparatus for printing upon an article comprising;

a rotating drum having an opening in its periphery, a rotating shaft in said drum, at least one drive pulley in said drum engageable with said rotating shaft, guide means in said drum spaced from said drive pulley and adjacent said opening, at least one endless belt having a plurality of spaced type sections disposed therealong, trained over said drive pulley and said guide means and movable through a path bringing a selected one of said plurality of type sections into a position aligned with said opening, transmission means selectively connectable between said drive pulley and said rotating shaft for engaging said drive pulley with said rotating shaft to move said endless belt and position a selected one of said type sections in said opening, control means externally of said rotating drum for activating said transmission means to selectively connect and disconnect said drive pulley and said rotating shaft; and means for advancing the article to be printed into association with the surface of said drum and said selected type section to impress an impression of said selected type section onto the article.

2. An apparatus for printing upon articles comprising: a rotatable horizontal drum having a longitudinal opening in its peripheral surface; printing means including movable flexible endless belts aligned side by side longitudinally of the drum in at least one row and arranged within the drum, each of the endless belts being provided with a plurality of spaced printing type on its outer peripheral surface, the printing type being positionable outside the drum at the opening when most remote from the center of the drum, power transmitting means provided for the belts respectively and each including an electromagnetic clutch, first slip ring segments for feeding current to the electromagnetic clutches respectively, said first slip ring segments being mounted substantially on the drum and arranged on circular lines substantially concentric with the axis of the drum, means for detecting the displacement of each of the printing means as an electric pulse every time the printing means is displaced by an amount corresponding to one spacing between said type, second slip ring segments for feeding current to the detecting means respectively, said second slip ring segments being mounted substantially on the drum and arranged on circular lines substantially concentric with the axis of the drum, means for detecting a reference point on each of said belts, control means for selectively determining the duration of energization of said electromagnetic clutch based on inputs thereto from said displacement detecting and reference point detecting means, so as to cause said belt to bring a specified printing type thereon to the outside position at the drum opening.

3. An apparatus as defined in claim 2 wherein said control means for selectively determining the duration of energization of said electromagnetic clutch is a computer.

4. An apparatus as defined in claim 3, wherein said computer further includes means for receiving type setting information and means for converting said type setting information into impulses sent to said first and second slip ring segments, said converting means including means for counting the impulses from said displacement detecting means after an impulse is received from said reference point detecting means.

5. An apparatus as defined in claim 2 wherein each of said transmitting means is a pulley having a side recess, said electromagnetic clutch being disposed in the recess of said pulley.

6. An apparatus as defined in claim 2 further including two drive shafts for driving said transmitting means arranged parallel to each other for one row of said aligned belts and provided within the drum longitudinally thereof, the transmitting means for the belt oddnumbered in the order of arrangement of the aligned belts being mounted on one of the shafts, the transmitting means for the even-numbered belts being mounted on the other shaft.

7. An apparatus as defined in claim 6 wherein each of said transmitting means is a pulley having a side recess, the electromagnetic clutch being disposed in said recess of the pulley.

8. An apparatus as defined in claim 2 further comprising:

means for conveying an article to be printed to a printing position, means pivotable about a horizontal rod to support the drum and operable to hold the drum in its raised position away from the printing position while the drum is out of printing operation, means for sensing the article upon the article being brought to the printing position by the conveying means, detector means for detecting the phase of the drum upon the completion of printing operation, means for lowering the drum from its raised position onto the article in response to the detection by the sensing means and for raising the drum in response to the detection by the detector means, detector means for detecting the phase of the drum when the drum has been lowered onto the article to stop the drum in its lowered position, and detector means for detecting the phase of the drum when the drum has been brought up to its raised position to stop the drum in its raised position.

9. An apparatus as defined in claim 8 wherein the sensing means comprises a photoelectric cell, and each of all the detector means comprises a proximity switch and an actuator piece.

10. An apparatus as defined in claim 8, wherein said article conveying means further comprises a conveyor for horizontally conveying the article to said drum and said drum lowering means further comprises an air cylinder.

11. An apparatus as defined in claim 8, further comprising rotation means connected to said drum for rotating said drum at an angular velocity equal to the velocity of the article on said conveying means.

12. An apparatus as defined in claim 2, wherein said displacement detecting further comprises a proximity switch mounted substantially on said drum and actuator pieces cooperative with said switch, being attached to said transmitting means for said belt of said printing means and spaced apart circumferentially on said transmitting means by a distance corresponding to said spacing between said type on said belt.

13. An apparatus as defined in claim 2, wherein said reference point detecting means of said belt comprises a proximity switch mounted on said drum and an actuator piece cooperative with said switch and attached to said belt.

14. An apparatus as defined in claim 2, further including releasable stopping means for restraining said belt against movement while said belt is stopped and recesses cooperative with said stopping means, each of said transmitting means being a pulley, said recesses being formed in said pulley and spaced apart circumferentially on said pulley by a distance corresponding to said spacing between said type on said belt.

* * * * *